US007110505B2

(12) United States Patent
Suzuki et al.

(10) Patent No.: US 7,110,505 B2
(45) Date of Patent: Sep. 19, 2006

(54) X-RAY SOURCE AND NONDESTRUCTIVE INSPECTOR

(75) Inventors: Kazutaka Suzuki, Hamamatsu (JP); Michihiro Ito, Hamamatsu (JP); Takatoshi Yoshiyama, Hamamatsu (JP); Hiroki Kawakami, Hamamatsu (JP); Tutomu Inazuru, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 11/365,846

(22) Filed: Mar. 2, 2006

(65) Prior Publication Data

US 2006/0153336 A1 Jul. 13, 2006

Related U.S. Application Data

(63) Continuation of application No. 10/787,826, filed on Feb. 27, 2004, now Pat. No. 7,031,433.

(51) Int. Cl.
*H01J 35/16* (2006.01)
*H01J 35/02* (2006.01)

(52) U.S. Cl. ..... 378/121; 378/102

(58) Field of Classification Search ..... 378/102, 378/121

See application file for complete search history.

(56) References Cited

U.S. PATENT DOCUMENTS

| | | | | |
|---|---|---|---|---|
| 1,986,482 | A * | 1/1935 | McKay | 378/202 |
| 2,090,636 | A * | 8/1937 | Olshevsky | 378/143 |
| 3,217,164 | A | 11/1965 | Williams et al. | |
| 4,104,531 | A * | 8/1978 | Weiss | 378/38 |
| 4,646,338 | A | 2/1987 | Skillicorn | 378/110 |
| 4,646,480 | A | 3/1987 | Williams | 51/424 |
| 4,984,261 | A | 1/1991 | Maldonado et al. | 378/202 |
| 5,077,771 | A | 12/1991 | Skillicorn et al. | 378/102 |
| 6,205,200 | B1 * | 3/2001 | Boyer et al. | 378/101 |
| 6,490,341 | B1 * | 12/2002 | Ochiai et al. | 378/140 |
| 6,940,341 | B1 | 12/2002 | Ochiai et al. | 378/140 |
| 6,563,908 | B1 * | 5/2003 | Enck, Jr. | 378/123 |
| 7,031,433 | B1 * | 4/2006 | Suzuki et al. | 378/121 |
| 2003/0081730 | A1 | 5/2003 | Thandiackal et al. | 378/121 |

FOREIGN PATENT DOCUMENTS

| | | |
|---|---|---|
| JP | 05-152093 | 6/1993 |
| JP | 07-29532 | 1/1995 |
| JP | 11-224624 | 8/1999 |

* cited by examiner

*Primary Examiner*—Edward J. Glick
*Assistant Examiner*—Thomas Artman
(74) *Attorney, Agent, or Firm*—Drinker Biddle & Reath LLP

(57) ABSTRACT

The present invention discloses an X-ray source comprising an X-ray source including a high-voltage applying part for generating an X-ray projecting from a bulb part; a power supply including an insulating block molding therein a voltage generating part for supplying a voltage to the high-voltage applying part; and a metallic tubular member accommodating the bulb part and securing the X-ray tube. The metallic tubular member is secured to the outside of the insulating block. The metallic tubular member encapsulates therein an insulating liquid material for the bulb part to be dipped therein.

9 Claims, 6 Drawing Sheets

X-RAY SOURCE AND NONDESTRUCTIVE INSPECTOR

This is a continuation application of application Ser. No. 10/787,826 filed Feb. 27, 2004 now U.S. Pat. No. 7,031,433. The application Ser. No. 10/787,826 is incorporated by reference herein in its entirety.

BACKGROUND OF THE INVENTION

1. Field of the Invention

The present invention relates to an X-ray source in which an X-ray tube and its power supply are integrated with each other, and a nondestructive inspection apparatus comprising an X-ray generator incorporating the X-ray source therein.

2. Related Background Art

A nondestructive inspection apparatus for observing the internal structure of a sample as a fluoroscopic image without destroying the sample uses an X-ray generator incorporating therein an X-ray tube for irradiating the sample with an X-ray, an X-ray imaging apparatus (XI) detecting the X-ray transmitted through the sample, etc. This nondestructive inspection apparatus obtains a fluoroscopic image with a greater magnification as the distance from an X-ray generating point to the sample is shorter.

As the X-ray source emitting an X-ray, one in which an X-ray tube and its power supply are integrated with each other has conventionally been known in general (see, for example, U.S. Pat. No. 5,077,771, U.S. Pat. No. 4,646,338, and U.S. Pat. No. 4,646,480). As such a kind of integrated X-ray source, the X-ray source A shown in FIG. 1 has conventionally been known in general.

The X-ray source A shown in FIG. 1 comprises a power supply B having a structure in which a high-voltage generating part B2, a high-voltage line B3, a socket B4, etc. are molded in an insulating block B1 made of an epoxy resin; and an X-ray tube C incorporated therein such that a bulb part C1 is dipped into a high-voltage insulating oil B6 in a reservoir recess B5 formed in the insulating block B1.

Fixed onto the surface of the insulating block B1 on the side where the reservoir recess B5 opens in the power supply B is a shield plate B7 securing the X-ray tube C and covering the opening of the reservoir recess B5. A bottom plate B8 is secured to the opposite surface of the insulating block B1. The shield plate B8 is formed with an opening B9 through which the bulb part C1 of the X-ray tube C is inserted, whereas an attachment flange C2 of the X-ray tube C is secured to the surroundings of the opening B9.

The X-ray tube C comprises the bulb part C1 accommodating therein a support member C3 (having a target), an X-ray generating part C5 containing a target C4 at the leading end part of the support member C3 (having the target), and an electron gun part C6 accommodating an electron gun (not depicted) which emits an electron beam to the target C4. The X-ray generating part C5 is arranged concentrically with the bulb part C1 on the opposite side of the attachment flange C2 from the bulb part C1, whereas the axis of the electron gun part C6 is orthogonal to the axis of the X-ray generating part C5 and bulb part C1.

Such an X-ray tube C is constructed so as to receive a high voltage from the high-voltage generating part B2 of the power supply B by way of the high-voltage line B3 when a high-voltage applying part C7 at the base end part of the support member C3 (having the target) projecting from the bulb part C1 fits into the socket B4 molded in the insulating block B1 of the power supply B. When the electron gun emits an electron beam to the target in this state, an X-ray generated in response to the electron beam incident on the target is emitted from an X-ray exit window.

Though the conventional X-ray source A shown in FIG. 1 comprises the reservoir recess B5 for dipping the bulb part C1 of the X-ray tube C into the high-voltage insulating oil B6 and keeping the resistance to voltage, the reservoir recess B5 is formed in the insulating block B1 and is covered with the shield plate B7, which has been considered problematic in terms of heat dissipation.

SUMMARY OF THE INVENTION

It is therefore an object of the present invention to provide an X-ray tube which can accelerate the heat dissipation from the bulb part thereof and an insulating liquid material in which the bulb part is dipped.

In one aspect, the present invention provides an X-ray source comprising an X-ray source including a high-voltage applying part for generating an X-ray projecting from a bulb part, a power supply including an insulating block molding therein a voltage generating part for supplying a voltage to the high-voltage applying part, and a metallic tubular member accommodating the bulb part and securing the X-ray tube; wherein the metallic tubular member is secured to the outside of the insulating block; and wherein the metallic tubular member encapsulates therein an insulating liquid material for the bulb part to be dipped therein.

In the X-ray source in accordance with the present invention, the metallic tubular member for accommodating the bulb part of the X-ray tube in a state dipped in the insulating liquid material is secured to the outside of the insulating block, and thus exhibits a favorable thermal dissipation characteristic, whereby the dissipation of heat from the insulating liquid material and the bulb part of the X-ray tube within the metallic tubular member is accelerated.

In another aspect, the present invention provides an X-ray source comprising an X-ray-tube in which an axis of a bulb part from which a high-voltage applying part of a support electrically connected to a target (having a target) projects and an axis of an electron gun part containing an electron gun intersect, a power supply including an insulating block molding therein a voltage generating part for supplying a voltage to the high-voltage applying part, and a metallic tubular member accommodating the bulb part and securing the X-ray tube; wherein the metallic tubular member is secured to the outside of the insulating block; and wherein the metallic tubular member encapsulates therein an insulating liquid material for the bulb part to be dipped therein.

The metallic tubular member for accommodating the bulb part of the X-ray tube in a state dipped in the insulating liquid material is secured to the outside of the insulating block, and thus exhibits a favorable thermal dissipation characteristic in the X-ray source in accordance with this aspect of the present invention as well, whereby the dissipation of heat from the insulating liquid material and the bulb part of the X-ray tube within the metallic tubular member is accelerated.

Preferably, in the X-ray source in accordance with any of the aspects of the present invention, the metallic tubular member is secured to the outside of the insulating block by way of a planar member.

When the metallic tubular member is formed like a cylinder and is arranged concentrically with the bulb part of the X-ray tube in the X-ray source in accordance with any aspect of the present invention, the distance from the support member (having the target) to the metallic tubular member becomes constant, whereby stability improves in electric fields formed about the support member (having the target) and target.

When a wall surrounding the high-voltage applying part of the support member (having the target) protruded from the bulb part of the X-ray tube and shielding the high-voltage applying part from the metallic tubular member projects from the insulating block of the power supply, this wall effectively prevents abnormal discharges from the high-voltage applying part to the metallic tubular member from occurring.

When used as being incorporated in an X-ray generator of a nondestructive inspection apparatus for observing the internal structure of a sample as a fluoroscopic image, the X-ray source in which the metallic tubular member has a leading end part with a sloped or tapered peripheral face and thus is tapered can incline the sample and sample mounting table greatly so as to make them approach the X-ray tube until they come into contact with the sloped or tapered peripheral face of the leading end part of the metallic tubular member, whereby the nondestructive inspection of the sample can be carried out in more details with a higher accuracy.

DESCRIPTION OF THE PREFERRED EMBODIMENTS

In the following, embodiments of the X-ray source in accordance with the present invention will be explained with reference to the drawings. Among the drawings referred to, FIG. 2 is an exploded perspective view showing the overall structure of the X-ray source in accordance with an embodiment, whereas FIG. 3 is a vertical sectional view showing the internal structure of the X-ray source in accordance with this embodiment.

Figure 1:
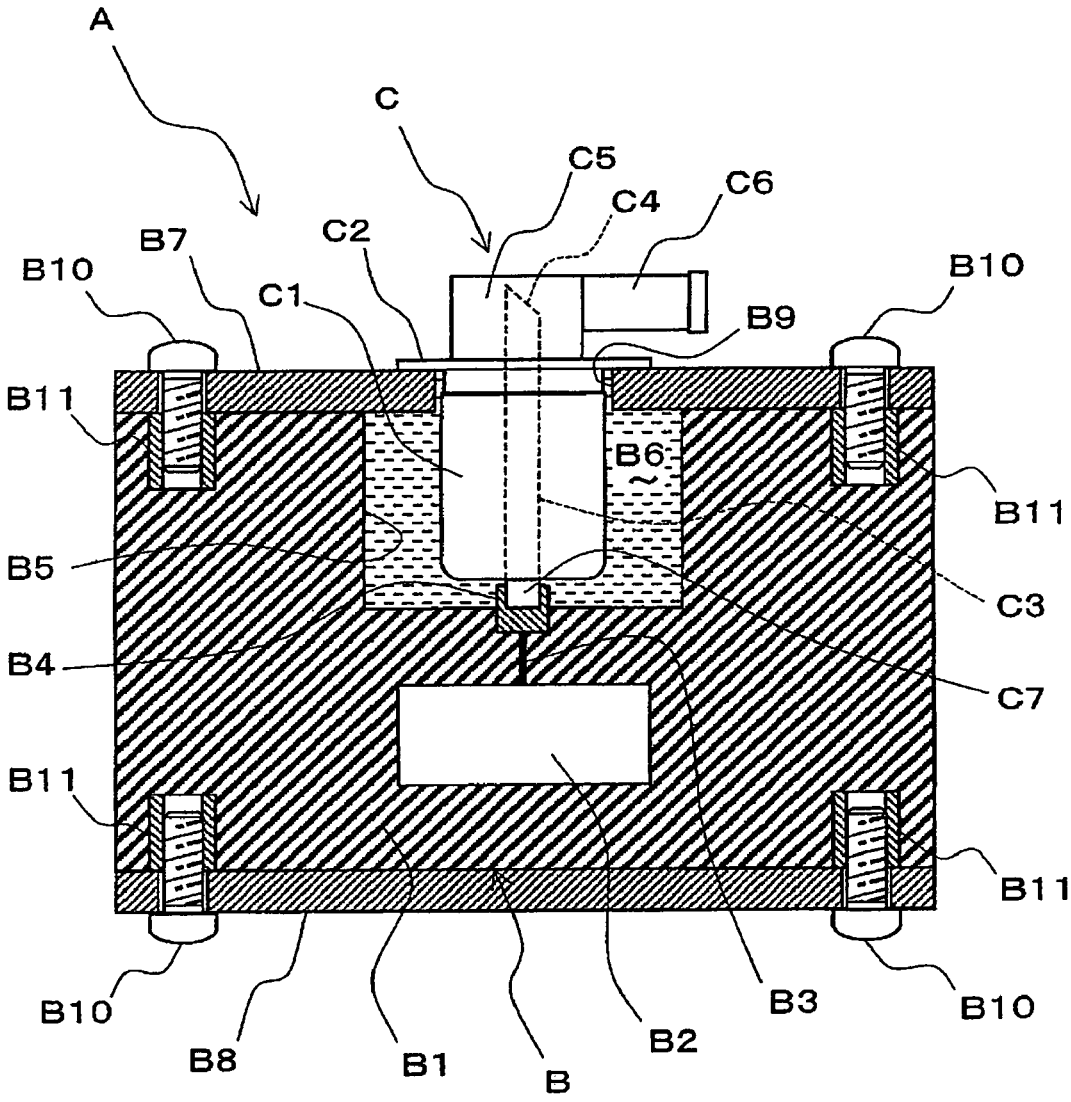
FIG. 1 is a vertical sectional view showing the internal structure of the X-ray source in accordance with a conventional example.
Figure 2:
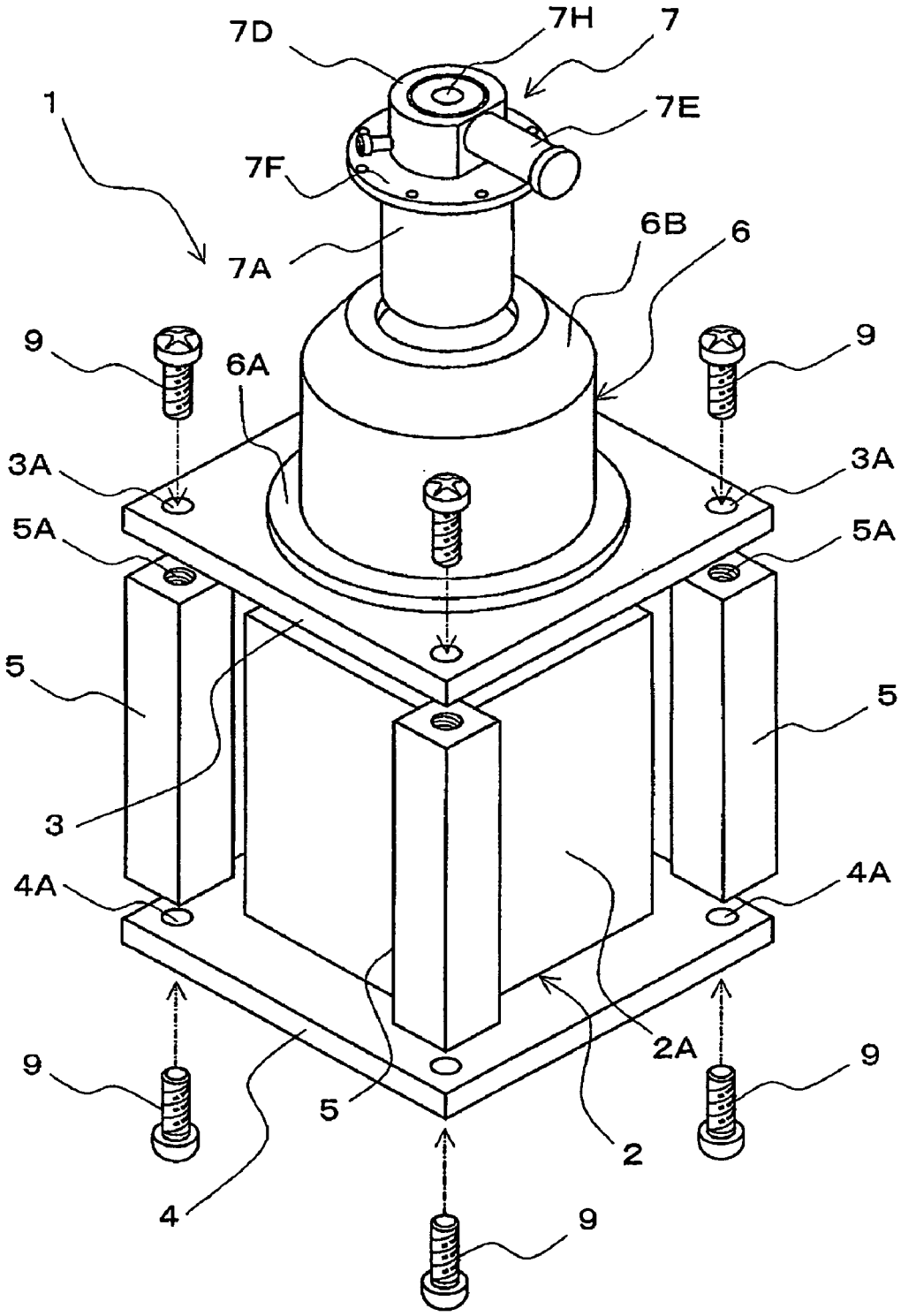
FIG. 2 is an exploded perspective view showing the overall structure of the X-ray source in accordance with an embodiment of the present invention.
Figure 3:
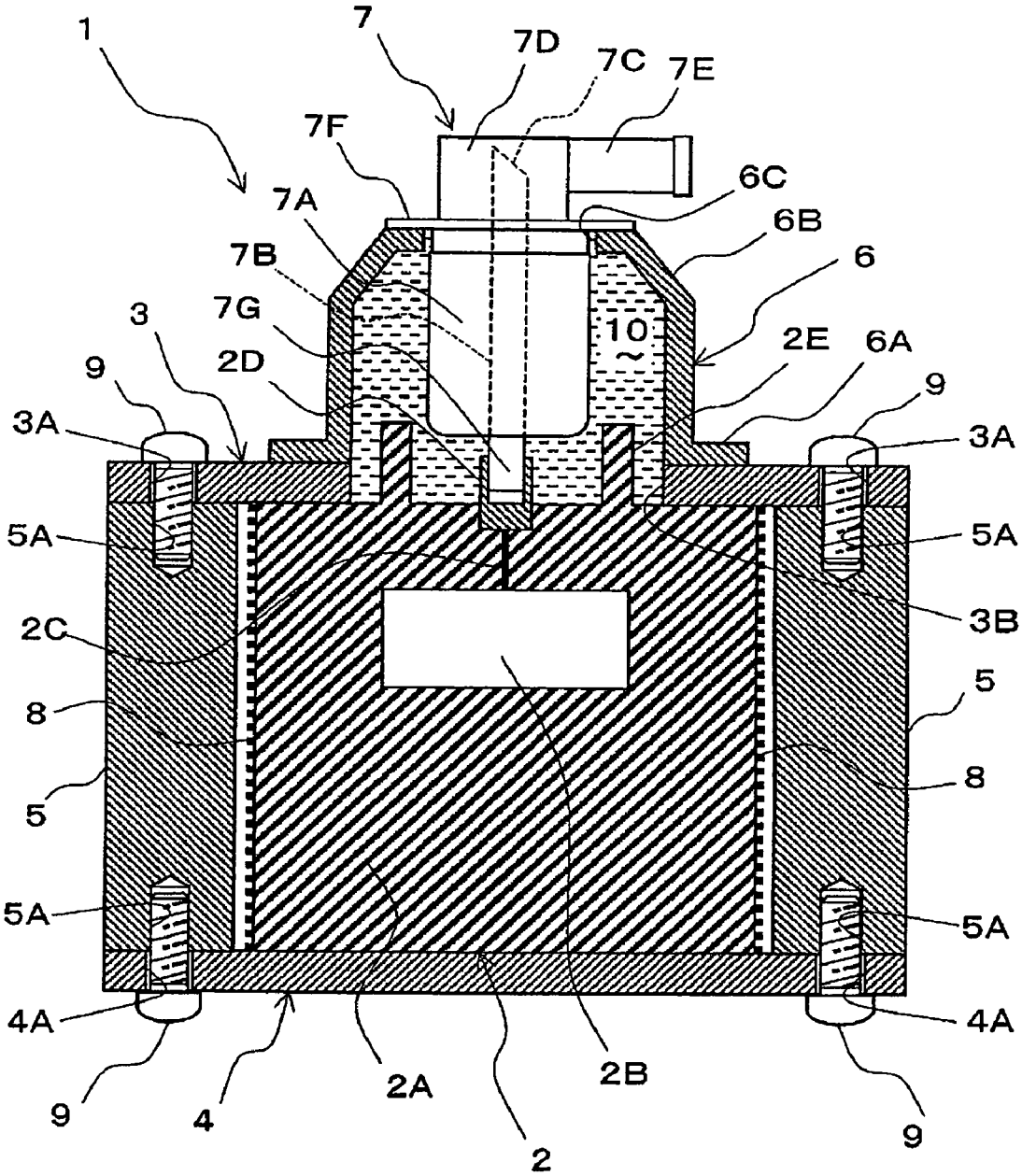
FIG. 3 is a vertical sectional view showing the internal structure of the X-ray source in accordance with the embodiment.

As shown in FIGS. 2 and 3, the X-ray source 1 in accordance with the first embodiment comprises a power supply 2 having a structure in which a high-voltage generating part 2B, a high-voltage line 2C, a socket 2D, etc. (see FIG. 2) are molded in an insulating block 2A made of an epoxy resin; a first planer member 3 disposed on the upper face side of the insulating block 2A depicted on the upper face side in the drawing; a second planar member 4 disposed on the lower face side of the insulating block 2A; four fastening spacer members 5 interposed between the first planer member 3 and second planar member 4; and an X-ray tube 7 secured onto the first planar member 3 by way of a metallic tubular member 6.

The insulating block 2A of the power supply 2 is shaped like a rectangular column with substantially square upper and lower faces parallel to each other, whereas the cylindrical socket 2D connected to the high-voltage generating part 2B by way of the high-voltage line 2C is disposed at the center part of the upper face. An annular wall 2E arranged concentrically with the socket 2D projects from the upper face of the insulating block 2A. The peripheral face of the insulating block 2A is coated with conductive paint 8 for attaining the GND potential (ground potential).

The first planar member 3 and second planar member 4 are members cooperating with four fastening spacer members 5 and eight fastening screws 9, for example, so as to hold the insulating block 2A of the power supply 2 from the upper and lower sides in the drawing, and are shaped into substantially square forms greater than the upper and lower faces of the insulating block 2A, respectively. At the corners of the first planar member 3 and second planar member 4, screw insertion holes 3A, 4A for inserting the fastening screws 9 are formed. The first planar member 3 is formed with a circular opening 3B surrounding the annular wall 2E projecting from the upper face of the insulating block 2A.

The four fastening spacer members 5, each formed like a square column, are disposed at the corners of the first planer member 3 and second planar member 4. Each fastening spacer member 5 is slightly shorter than the gap between the upper and lower faces of the insulating block 2A, i.e., by the fastening margin of the insulating block 2A. The upper and lower end faces of each fastening spacer member 5 are formed with respective screw holes 5A into which a fastening screw 9 is screwed.

The metallic tubular member 6 is shaped like a cylinder, whereas an attachment flange 6A formed at the base end part thereof is secured to the surroundings of the opening 3B of the first planar member 3 by screwing by way of a seal member which is not depicted. The peripheral face of the leading end part of the metallic tubular member 6 is formed into a tapered surface 6B, whereby the metallic tubular member 6 attains a tapered leading end part with no corners. A flat leading end face continuing to the tapered surface 6B of the metallic tubular member 6 is formed with an opening 6C through which a bulb part 7A of the X-ray tube 7 is inserted.

The X-ray tube 7 is a reflection type X-ray tube comprising the bulb part 7A holding and accommodating a support member 7B (having a target) while being insulated from the support member 7B, an X-ray generating part 7D containing a target 7C provided at the leading end part of the support member 7B, and an electron gun part 7E for emitting an electron beam to the target 7C.

The bulb part 7A and the X-ray generating part 7D are arranged concentrically, whereas their axis is substantially orthogonal to the axis of the electron gun part 7E. An attachment flange 7F to be secured to the leading end face of the metallic tubular member 6 is formed between the bulb part 7A and the X-ray generating part 7D. As a high-voltage applying part 7G, the base end part of the support member 7B (having the target) projects downward from the center part of the bulb part 7A (see FIG. 3).

The X-ray tube 7 is provided with an exhaust pipe, through which the bulb part 7A, the X-ray generating part 7D, and the electron gun part 7E are evacuated, whereby a sealed vacuum container is formed.

Such an X-ray tube 7 is constructed so as to receive a high voltage from the high-voltage generating part 2B by way of the high-voltage line 2C when the high-voltage applying part 7G fits into the socket 2D molded in the insulating block 2A of the power supply 2. When an electron gun built in the electron gun part 7E emits an electron beam to the target 7C in this state, an X-ray generated in response to the electron beam incident on the target 7C is emitted from an X-ray exit window 7H attached to the opening of the X-ray generating part 7D.

The X-ray source 1 in accordance with this embodiment is assembled by the following manner, for example. First, four fastening screws 9 inserted through their corresponding screw insertion holes 4A of the second planar member 4 are screwed into the respective screw holes 5A in the lower end faces of the four fastening spacer members 5. Subsequently, four fastening screws 9 inserted through their corresponding screw insertion holes 3A of the first planar member 3 are screwed into the respective screw holes 5A in the upper end faces of the four fastening spacer members 5, whereby the first planer member 3 and second planar member 4 are fastened to each other while holding the insulating block 2A from the upper and lower sides. Here, respective seal members are interposed between the first planer member 3 and the upper face of the insulating block 2A, and between the second planer member 4 and the lower face of the insulating block 2A.

Next, a high-voltage insulating oil 10 is injected as an insulating liquid material into the opening 6C of the metallic tubular member 6 secured onto the first planar member 3. Subsequently, the bulb part 7A of the X-ray tube 7 is inserted into the metallic tubular member 6 from the opening 6C thereof, so as to be dipped into the high-voltage insulating oil 10, whereby the high-voltage applying part 7G projecting downward from the center part of the bulb part 7A fits into the socket 2D on the power supply 2 side. Then, the attachment flange 7F of the X-ray tube 7 is secured to the leading end face of the metallic tubular member 6 by screwing by way of a seal member which is not depicted.

In thus assembled X-ray source 1 in accordance with this embodiment, as shown in FIG. 3, the annular wall 2E projecting from the upper face of the insulating block 2A of the power supply 2 and the metallic tubular member 6 are arranged concentrically about the axis of the support member 7B (having the target) of the X-ray tube 7. The annular wall 2E surrounds the high-voltage applying part 7G protruded from the bulb part 7A of the X-ray tube 7, and projects by such a height as to shield the high-voltage applying part 7G from the metallic tubular member 6.

When a high voltage is applied to the high-voltage applying part 7G of the X-ray tube 7 from the high-voltage generating part 2B of the power supply 2 by way of the high-voltage line 2C and socket 2D in the X-ray source 1 in accordance with this embodiment, the target 7C is supplied with the high voltage by way of the support member 7B (having the target). When the electron gun incorporated in the electron gun part 7E of the X-ray tube 7 emits an electron beam to the target 7C accommodated in the X-ray generating part 7D in this state, an X-ray generated in response to the electron beam incident on the target 7C is emitted from the X-ray exit window 7H attached to the opening of the X-ray generating part 7D.

Since the metallic tubular member 6 accommodating the bulb part 7A of the X-ray tube 7 in the state dipped in the high-voltage insulating oil 10 is secured to the outside of the insulating block 2A of the power supply 2, i.e., onto the first planar member 3, while projecting therefrom, the thermal dissipation characteristic of the X-ray tube 1 is favorable, whereby the dissipation of heat from the high-voltage insulating oil 10 and the bulb part 7A of the X-ray tube 7 within the metallic tubular member 6 can be accelerated.

The metallic tubular member 6 is formed like a cylinder about the support member 7B (having the target), so as to keep the same distance from the support member 7B (having the target), and thus can stabilize electric fields formed about the support member 7B (having the target) and target 7C. This metallic tubular member 6 can effectively cause the charged high-voltage insulating oil 10 to discharge.

Since the annular wall 2E projecting from the upper face of the insulating block 2A of the power supply 2 surrounds the high-voltage applying part 7G projecting from the bulb part 7A of the X-ray tube 7 and shields it from the metallic tubular member 6, abnormal discharges from the high-voltage applying part 7G to the metallic tubular member 6 can effectively be prevented from occurring.

The X-ray source 1 in accordance with this embodiment comprises a structure in which the insulating block 2A of the power supply 2 is held between the first planar member 3 and second planar member 4 fastened to each other by way of the four fastening spacer members 5, whereas the inside of the insulating block 2A is free of conductive foreign matters inducing discharges and electrifiable foreign matters inducing disturbances in electric fields. Therefore, the X-ray source 1 in accordance with the first embodiment can suppress useless discharge phenomena and electric field disturbances in the power supply 2.

Figure 4:
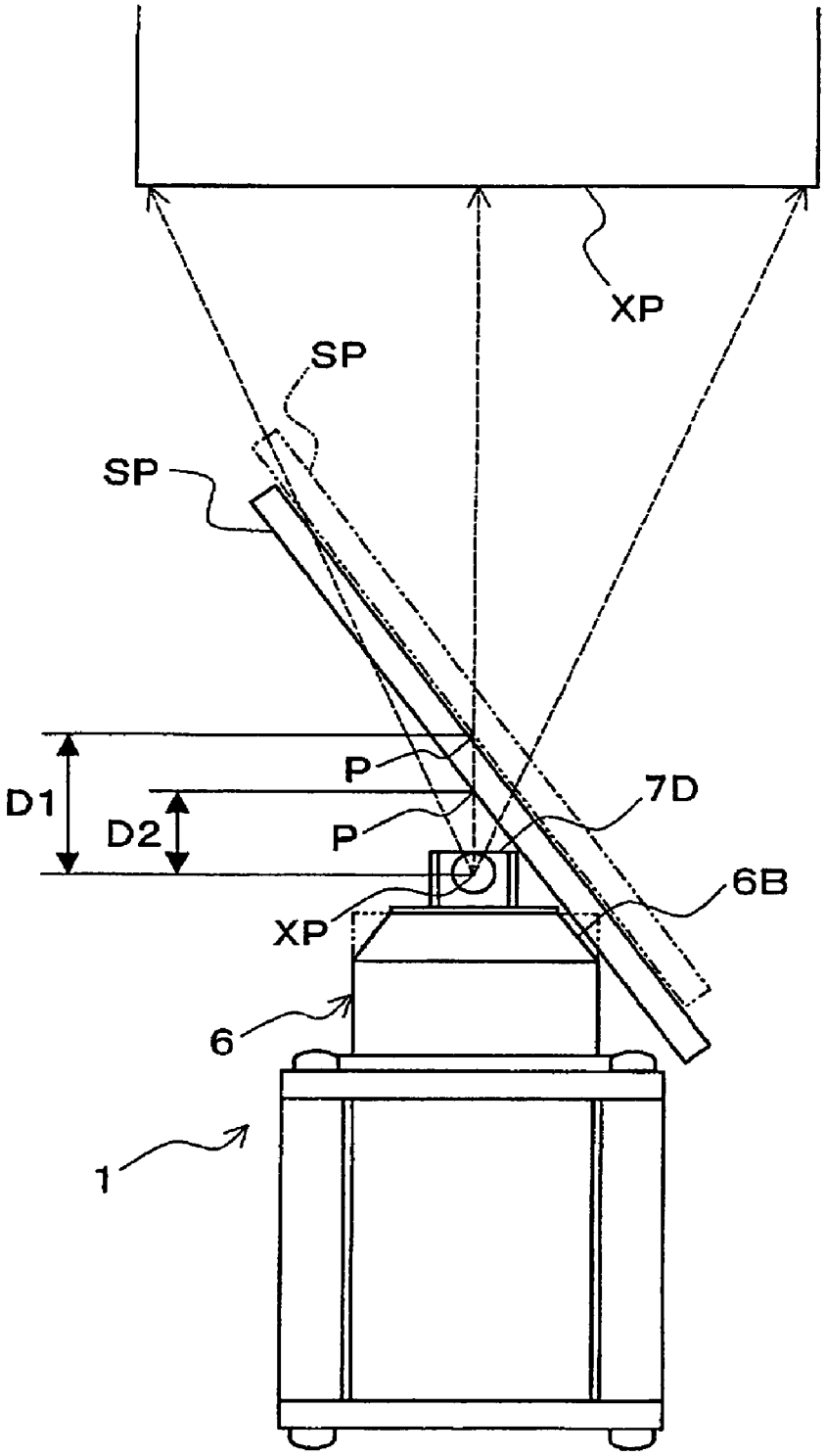
FIG. 4 is a front view for explaining operations of the X-ray source in accordance with the embodiment incorporated in an X-ray generator of a nondestructive inspection apparatus.

The X-ray source 1 in accordance with this embodiment is used while being incorporated into an X-ray generator (not depicted) for irradiating a sample with an X-ray in a nondestructive inspection apparatus for observing the internal structure of a sample as a fluoroscopic image, for example. FIG. 4 shows an example of use thereof, in which the X-ray source 1 emits an X-ray to a sample plate SP disposed between the X-ray source 1 and an X-ray imaging apparatus (XI). Namely, the X-ray source 1 irradiates the sample plate SP with the X-ray through the X-ray exit window from the X-ray generating point XP of the target incorporated in the X-ray generating part 7D projecting above the metallic tubular member 6.

In such an example, since the magnification of the fluoroscopic image of the sample plate SP obtained by the X-ray imaging apparatus (XI) becomes greater as the distance from the X-ray generating point XP to the sample plate SP is shorter, the sample plate SP is usually disposed close to the X-ray generating point XP. When observing the internal structure of the sample plate SP three-dimensionally, the sample plate SP is inclined about an axis orthogonal to the X-ray irradiating direction.

If corners indicated by dash-double-dot lines remain in the leading end part of the metallic tubular member 6 in the X-ray source 1 as shown in FIG. 4 when three-dimensionally observing the observation point P of the sample plate SP while disposing it close to the X-ray generating point XP in a state where the sample plate SP is inclined about an axis orthogonal to the X-ray irradiating direction, the observation point P of the sample plate SP cannot approach the X-ray generating point XP from the position where the sample plate SP is in contact with the leading end corner of the metallic tubular member 6, i.e., the position where the distance from the X-ray generating point XP to the observation point P is D1.

In the X-ray source 1 in accordance with this embodiment in which the leading end part of the metallic tubular member 6 is tapered by the taper surface 6B so as to yield no corners as shown in FIGS. 2 and 3, by contrast, the observation point P of the sample plate SP can approach the X-ray generating point XP up to the position where the sample plate SP comes into contact with the taper surface 6B of the metallic tubular member 6, i.e., the position where the distance from the X-ray generating point XP to the observation point P becomes D2, as indicated by solid lines in FIG. 4. As a result, the fluoroscopic image of the observation point P of the sample plate SP can be magnified more, so as to carry out a nondestructive inspection of the observation point P more accurately.

The X-ray source in accordance with the present invention is not limited to the above-mentioned embodiment. For example, the metallic tubular member 6 preferably has an inner peripheral face with a circular cross section, but its outer peripheral face may be shaped like a polygon such as rectangle without being restricted to circular forms. When the outer peripheral face has a polygonal cross section, peripheral faces of the leading end part of the metallic tubular member can be formed like slopes.

The insulating block 2A of the power supply 2 may be formed like a cylindrical column, and the first planar member 3 and second planar member 4 may be formed like disks correspondingly thereto. The fastening spacer members 5 may be formed like a cylindrical column, whereas their number is not limited to 4.

The X-ray tube 7 may have a structure in which an electron gun is arranged in the bulb part 7A.

Figure 5:
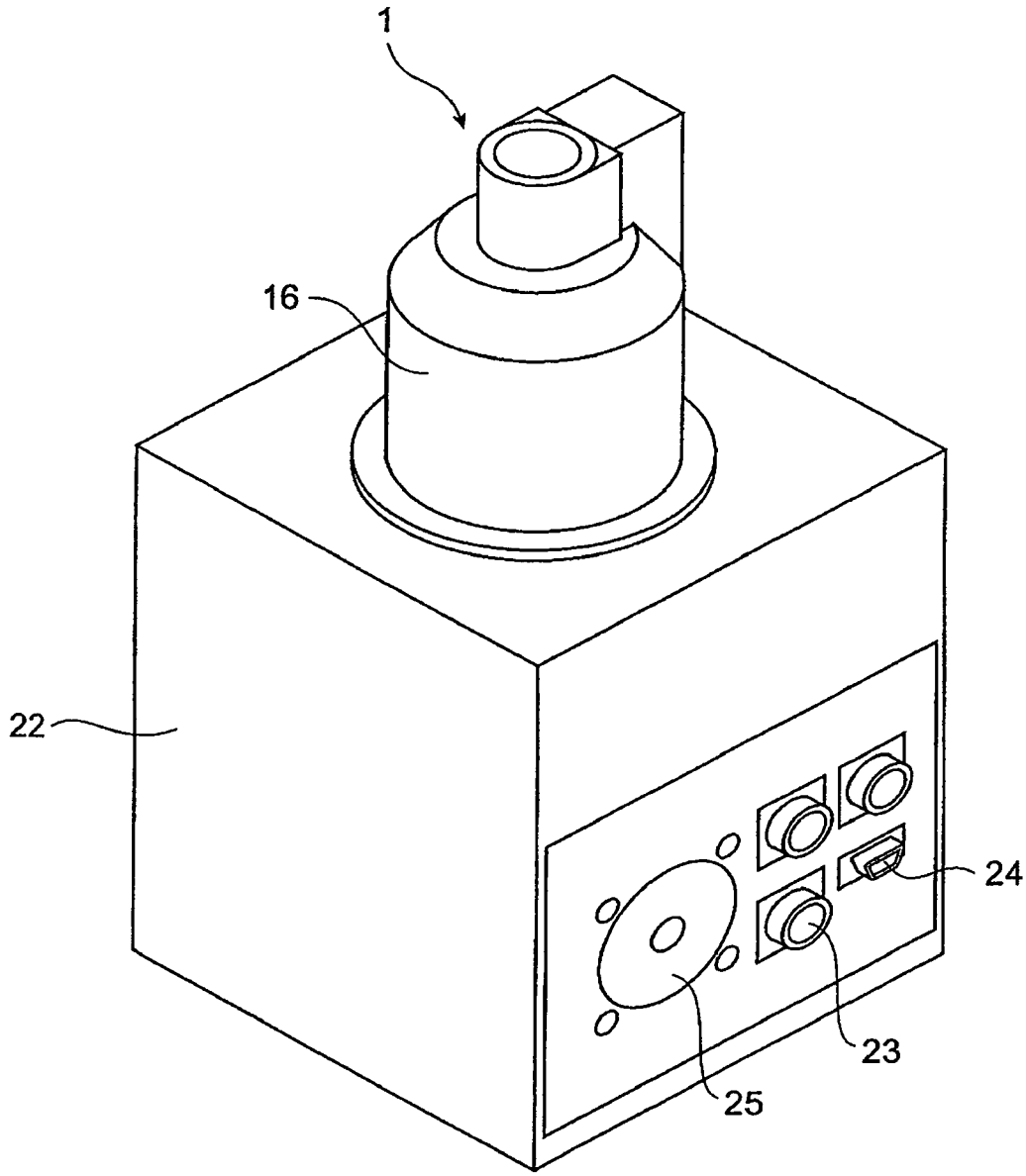
FIG. 5 is a schematic perspective view of an X-ray source incorporating therein the X-ray tube in accordance with another embodiment.

FIG. 5 shows a schematic perspective view of an X-ray source incorporating therein an X-ray tube 7I in accordance with another embodiment.

As shown in FIG. 5, the X-ray tube 7I is secured to a block 22 by way of a metallic tubular member 6 as in the embodiment shown in FIG. 2. The upper part of the metallic tubular member 6 is provided with a truncated cone part 6B as shown in FIG. 5. As depicted, a power connector 23, a signal terminal 24, a cooling fan 25, etc. are attached to one side face of the block 22.

Figure 6:
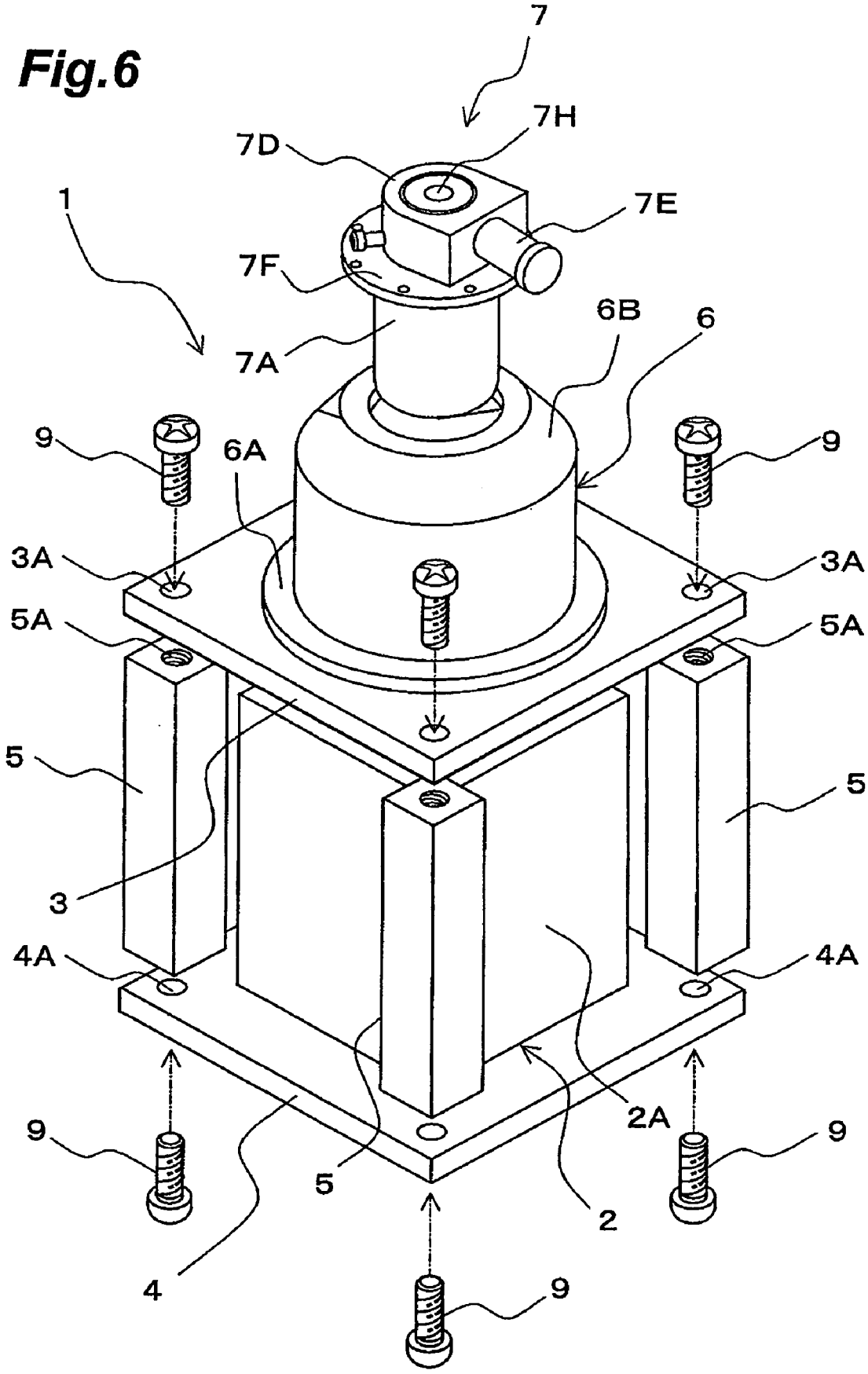
FIG. 6 is an exploded perspective view of the X-ray source shown in FIG. 5.

FIG. 6 is an exploded perspective view of the X-ray source shown in FIG. 5, illustrating a state without the casing part of the block 22 shown in FIG. 5.

As shown in FIG. 5, the X-ray generating part 17H has a form in which a semicylindrical part and a rectangular parallelepiped part are combined together. This embodiment is the same as that of FIG. 2 except for the form of the X-ray tube 7I, and thus will not be explained.

What is claimed is:

1. An X-ray source comprising:

an X-ray tube having an X-ray emitting window;

a power source having a power generator for supplying a voltage to the x-ray tube and an insulating block, the power generator being molded in the insulating block;

a metallic tubular member fixed to the power source so that the metallic tubular member projects from the power source, the metallic tubular member having an aperture, and a part of the x-ray tube being inserted into the aperture and fixed to the metallic tubular member so that the x-ray emitting window is positioned outside of the metallic tubular member; and insulating liquid material encapsulated into space which is surrounded by the X-ray tube, the metallic tubular member and the power source.

2. The X-ray source according to claim 1, wherein the X-ray tube further comprises a target and an electron gun part for emitting an electron beam to the target to generating X-ray from a position of the target at which the electron beam emitted from the electron gun abuts, and the position of the target is positioned outside of the metallic tubular member.

3. The X-ray source according to claim 1, wherein the X-ray tube comprising a flange and the X-ray tube is fixed to the metallic tubular member with the flange so as to close up the aperture.

4. An X-ray source comprising:

an X-ray tube having an X-ray emitting window;

a power source having a power generator for supplying the power to the X-ray tube, an insulating block and a power supplying part through which the power is supplied to the X-ray tube, the power generator being molded in the insulating block;

a metallic tubular member arranged so that the metallic tubular member projects from the power source, the X-ray tube being fixed the metallic tubular member so that the x-ray emitting window is positioned outside of the metallic tubular member, an insulating liquid material encapsulated within the metallic tubular member so that an electric contact between the power supplying part and the X-ray tube is covered with the insulating liquid material.

5. The X-ray source according to claim 4, wherein the X-ray tube further comprises a target and an electron gun part for emitting an electron beam to the target to generating X-ray from a position of the target at which the electron beam emitted from the electron gun abuts, and the position of the target is positioned outside of the metallic tubular member.

6. The X-ray source according to claim 4, wherein the X-ray tube comprising a flange and the X-ray tube is fixed to the metallic tubular member with the flange so as to close up the aperture.

7. An X-ray source comprising:

an X-ray tube having an X-ray emitting window;

a power source having a voltage generator for supplying the voltage to the X-ray tube and an insulating block, the voltage generator being molded in the insulating block; and a metallic tubular member having an aperture and arranged so that the metallic tubular member projects from the power source, a part of the X-ray tube being inserted into the aperture so that the x-ray emitting window is positioned outside of the metallic tubular member, the X-ray tube being fixed to the metallic tubular member and an insulating liquid material being encapsulated within the metallic tubular member.

8. The X-ray source according to claim 7, wherein the X-ray tube further comprises a target and an electron gun part for emitting an electron beam to the target to generating X-ray from a position of the target at which the electron beam emitted from the electron gun abuts, and the position of the target is positioned outside of the metallic tubular member.

9. The X-ray source according to claim 7, wherein the X-ray tube comprising a flange and the X-ray tube is fixed to the metallic tubular member with the flange so as to close up the aperture.

* * * * *